US005800276A

United States Patent [19]

Hill

[11] Patent Number: 5,800,276

[45] Date of Patent: Sep. 1, 1998

[54] BOWLING BALL INSERT

[76] Inventor: James R. Hill, P.O. Box 305-368 Sheehy Rd., McEwen, Tenn. 37101

[21] Appl. No.: 861,159

[22] Filed: May 21, 1997

Related U.S. Application Data

[60] Provisional application No. 60/018,477 May 28, 1996.

[51] Int. Cl.[6] ..... A63B 37/00

[52] U.S. Cl. ..... 473/128; 473/130

[58] Field of Search ..... 473/127, 128, 473/129, 130

[56] References Cited

U.S. PATENT DOCUMENTS

| | | | |
|---|---|---|---|
| 3,001,793 | 9/1961 | Insetta . | |
| 3,102,725 | 9/1963 | Jarus . | |
| 3,861,681 | 1/1975 | Kelsey . | |
| 4,247,102 | 1/1981 | Seyler . | |
| 4,561,654 | 12/1985 | Haza . | |
| 4,892,308 | 1/1990 | Gaunt . | |
| 4,968,033 | 11/1990 | Aluotto . | |
| 5,118,106 | 6/1992 | Goldman . | |
| 5,330,392 | 7/1994 | Bresin et al. . | |
| 5,505,666 | 4/1996 | Arsenault . | |
| 5,520,582 | 5/1996 | Lathrop | 473/130 |

FOREIGN PATENT DOCUMENTS

| | | |
|---|---|---|
| 636206 | 2/1962 | Canada . |
| 646053 | 7/1962 | Canada . |

*Primary Examiner*—William M. Pierce
*Attorney, Agent, or Firm*—Richard C. Litman

[57] ABSTRACT

An insert system for the finger and thumb holes of a bowling ball and a method for installing the insert system. The insert system includes a master that is bonded inside each of the holes. A number of inserts are provided having different internal diameters, shapes, and pitches (the angle of the hole relative to the ball's surface). Inserts are also provided that have offset internal holes, to allow for changes in finger span by rotating the insert relative to the master. The master is provided with tapered inner and outer surfaces. The taper on the outer surface helps in bonding the master to the ball by providing voids that are filled with adhesive. The tapered inner surface cooperates with a tapered outer surface on the insert, to lock the insert to the master. A round head screw assembly is additionally provided with each insert to insure that a shock of impact will not loosen the fit between the master and the insert.

15 Claims, 6 Drawing Sheets

BOWLING BALL INSERT

CROSS-REFERENCE TO RELATED APPLICATION

This application claims the benefit of U.S. Provisional Patent Application Ser. No. 60/018,477, filed May 28, 1996.

BACKGROUND OF THE INVENTION

1. Field of the Invention

The present invention relates to an insert system for the thumb and finger holes of a bowling ball, including a master insert bonded inside the hole, and a number of removable inserts for placement inside of the master. The present invention also relates to a method of installing an insert system in a bowling ball.

2. Description of Related Art

During the course of a bowling outing, a bowler may wish to change the size, pitch, (angle of the hole relative to the surface of the ball), and span of the holes of a bowling ball depending on several conditions. These conditions include but are not limited to; heat, humidity, cold weather, weight gain or loss, water retention, altitude, and personal injury. The present invention meets this requirement by providing an insert system for the thumb and finger holes of a bowling ball.

Inserts for the thumb hole and finger holes of bowling balls are known. U.S. Pat. No. 3,001,793, (Insetta), describes a two-piece bowling ball insert having a complex mechanism for locking the pieces together. U.S. Pat. No. 3,102,725, (Jarus), describes a two piece bowling ball insert having a groove and pin arrangement for locking the pieces together. U.S. Pat. No. 3,861,681, (Kelsey), describes a bowling ball insert having a sleeve and plug which can be rotated alone or together to adjust the span and pitch of the hole. U.S. Pat. No. 4,247,102, (Seyler), describes a one piece insert that has a threaded connection in a bowling ball hole. U.S. Pat. No. 4,561,654, (Haza), describes a bowling ball insert having a number of telescoping tubes that adjust the size of the internal hole of the insert. U.S. Pat. No. 4,892,308, (Gaunt), describes a bowling ball insert wherein a master is bonded to the hole, and an insert is screwed into the master. U.S. Pat. No. 4,968,033, (Aluotto), describes a bowling ball insert wherein an inner cup is attached to an outer cup using a screw. U.S. Pat. No. 5,118,106, (Goldman), describes a bowling ball insert kit having a number of inserts that connect to sleeves inside of the holes using a threaded connection or a locking tab mechanism. U.S. Pat. No. 5,330,392, (Bresin et al.), describes a one piece bowling ball insert. U.S. Pat. No. 5,505,666, (Arsenault), describes a two piece insert for a bowling ball wherein the an insert is connected to a receiver, (or master) using a screw and lock member. Canadian Patent 636,206 describes a two piece bowling ball insert having a complex mechanism for locking the pieces together. Canadian Patent 646,053 describes a three piece insert for a bowling ball.

None of the above inventions and patents, taken either singly or in combination, is seen to describe the instant invention as claimed.

SUMMARY OF THE INVENTION

The present invention includes a master that is bonded inside each of the holes of the bowling ball. Both the internal surface of the master and the external surface of the insert have a one degree taper from top to bottom. These tapers cause the insert and master to lock together when the insert is placed inside the master. A round head screw assembly is provided with each insert to insure that a shock of impact will not loosen this fit.

A number of inserts are provided having different internal diameters, pitches, and cross-sectional shaped. Inserts are also provided that have offset internal holes, to allow for changes in finger span by rotating the insert relative to the master.

Accordingly, it is a principal object of the invention to provide an insert system for a bowling ball, wherein a bowler can customize the fit of the bowling ball (including size and pitch of each hole, and span of the holes) for changing conditions.

It is another object of the invention to provide a mechanism wherein the inserts can be changed easily in a low light level area.

It is a further object of the invention to ensure a solid connection between an insert and a bowling ball, while allowing the connection to be made quickly.

Still another object of the invention is to provide an insert system that complies with ABC regulations.

It is an object of the invention to provide an improved insert and master for a bowling ball for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
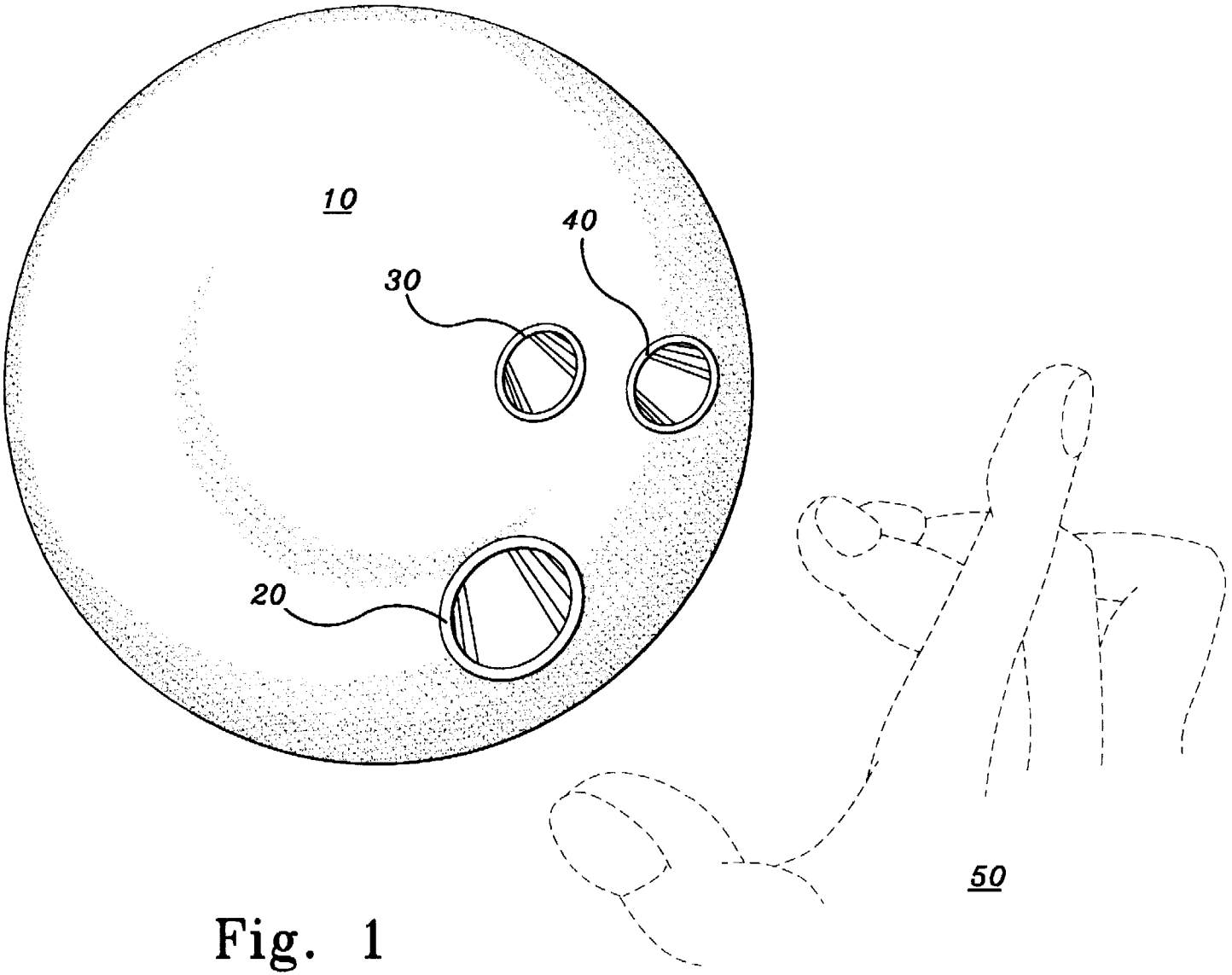
FIG. 1 is an environmental view of an insert according to the present invention showing each finger and thumb hole of a bowling ball.

The present invention is an insert system for a bowling ball as generally shown in FIG. 1. The bowling ball 10 has three inserts 20, 30, and 40 for accepting the thumb and two fingers of a bowler's hand 50.

Figure 2:
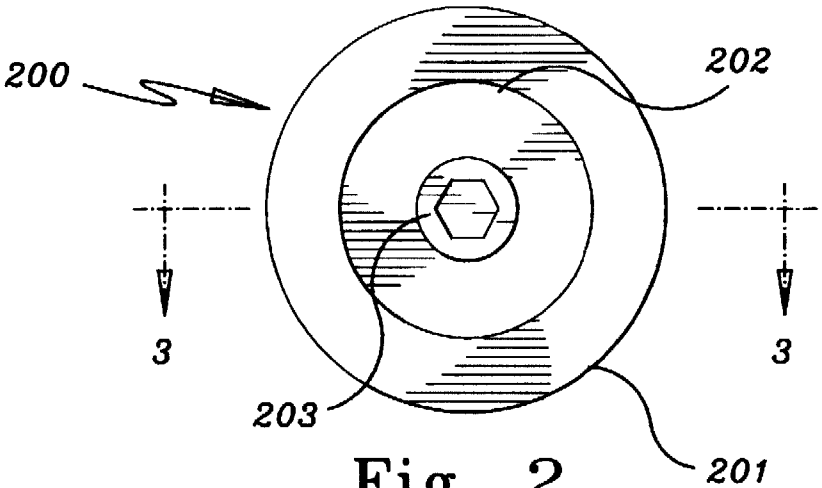
FIG. 2 is a top view of the first embodiment of the insert according to the instant invention.

In FIG. 2, a top view of the first embodiment of the insert system 200 is shown. The inner diameter 202 of insert 201 is centered within the insert. A round head hex screw 203 is used to connect the insert 201 and the master (not visible in this figure).

Figure 3:
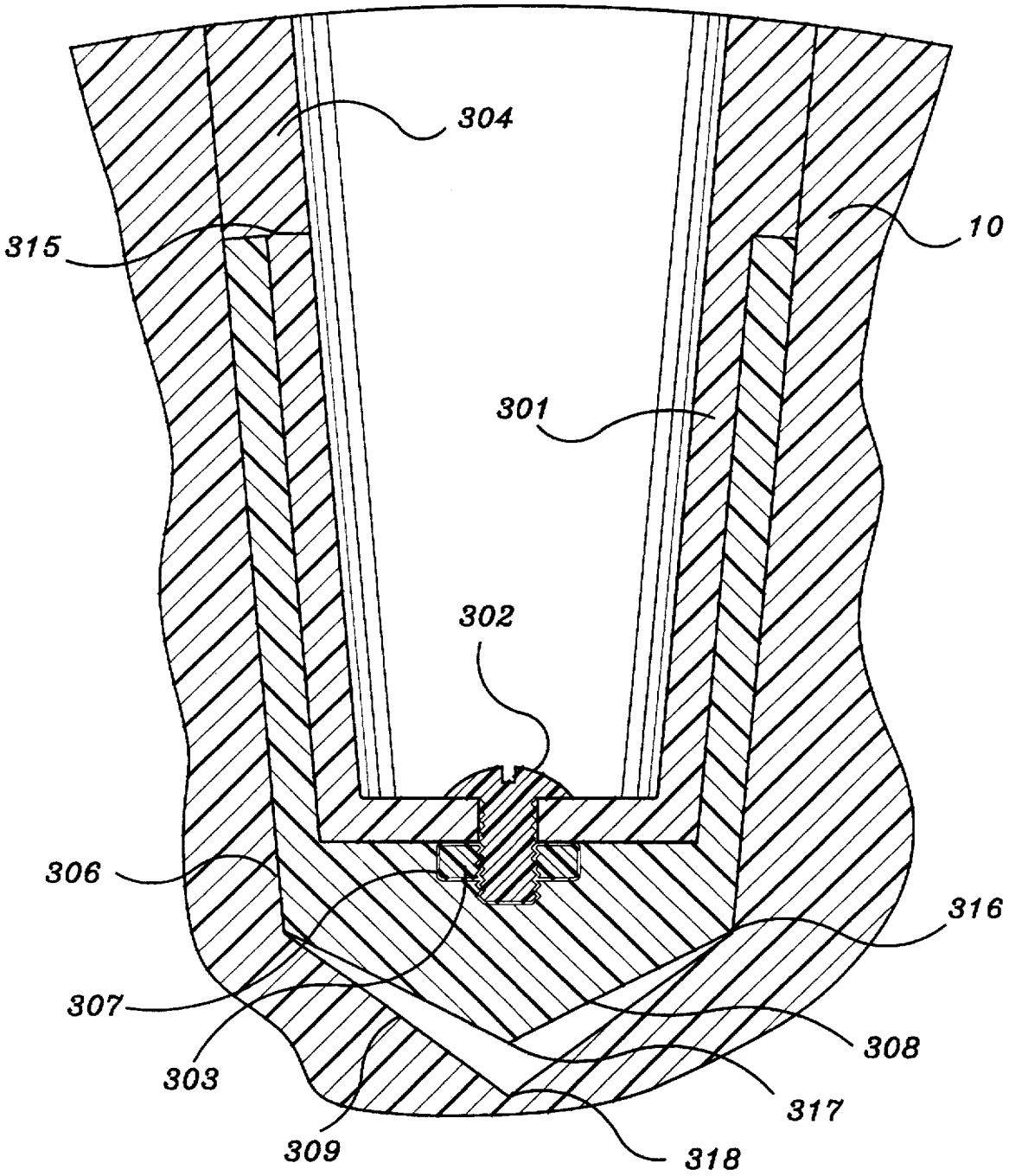
FIG. 3 is a sectional view of the first embodiment of the insert and the master taken along cross-section lines 3–3 of FIG. 2, and showing the locking nut and screw assembly.

The connection between the master and the insert of the first embodiment is better shown in FIG. 3. Bowling ball 10, has a master 306 bonded to the internal wall of a finger or thumb hole. The outside diameter of the master 306 has a one degree taper from the top end 315 of the master 306 to a pointed region 316 at the bottom of the master 306. The pointed region 316 at the bottom of the master 306 has a 65 degree taper 308 that ends in a point 317. The diameter of the top end 315 of the insert 301 is equal to the diameter of the holes in the bowling ball 10. The bottom of the holes in the bowling ball 10 have a 62 degree tapered surface 309 that end in a point 318.

The diameter of the hole of the bowling ball 10, and the diameter of the top end 315 of the insert are normally one and ¼ inch (industry standard), but may be one and ⅜ inch to provide for more material at the top of the insert. The master 306 is bonded to the internal wall of the hole of the bowling ball 10 using an appropriate adhesive. The difference in taper between the master and hole (one degree along the sides, and three degrees at the bottom) creates voids that are filled with the adhesive. The adhesive in these voids, helps to strengthen the bond between the master 306 and the bowling ball 10.

Once the master 306 is installed within the holes of the bowling ball 10, the bowler may then decide on an insert for use in the hole. The insert 301 is placed in the master 306, and the round head hex screw 302 is tightened in the threaded hole in the master using an allen wrench or hex key. Both the inner wall of the master and the outer wall of the insert have a one degree taper. This taper causes the master 306 and insert 301 to lock together in the same manner as nested cups. The hex screw 302 insures that a shock of impact will not loosen this fit.

A round nut 303 is bonded to hex screw 302, in close proximity to the insert 301. The round nut 303 allows the hex screw 302 to be disengaged from the master 306, while at the same time preventing the hex screw 302 from disengaging from the insert 301. The round nut 303 has internal threads that mate with the screw's threads, and an annular external edge which allows the screw 302 to spin freely in the clearance hole at the bottom of the insert 301.

In assembling each insert 301, a round head hex screw 302 is pushed through the clearance hole from inside the insert 301. A round nut 303 is then threaded onto the screw 302 and bonded in place using an appropriate adhesive. The master 306 has an annular cavity 307 for accepting the round nut 303 when the insert 301 is placed inside the master 306. The cavity 307 is deep enough to allow the screw 302 to tighten prior to contact between the round nut 303 and the bottom of the cavity 307. While 3 ½to 4 ½ turns are needed to completely insert or retract screw 302, only the last ½ to ¾ turn of screw 302 actually tightens or breaks loose the insert 301 from the master 306.

Each insert 301 is provided with a head or undercut 304. The head 304 has the aesthetic value of covering the master 306 and giving the appearance of only one piece in the ball 10. Additionally, the head 304 allows for more material at the top of the insert for a bowler to cut or grind a radius to fit their finger or thumb. This is accomplished by simply removing material from the top internal edge of the head 304.

To comply with ABC regulations, the master 306, insert 301, round head hex screw 302, and round nut 303, are made of nylon or other non-metallic plastic material. The preferred material of the round nut 303 is Delron.

Figure 4B:
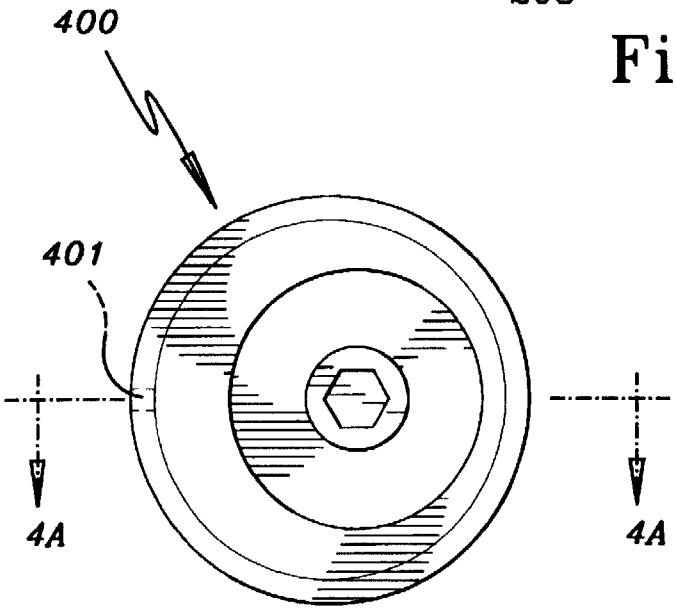
FIG. 4B is a top view of the second embodiment of the insert.
Figure 4A:
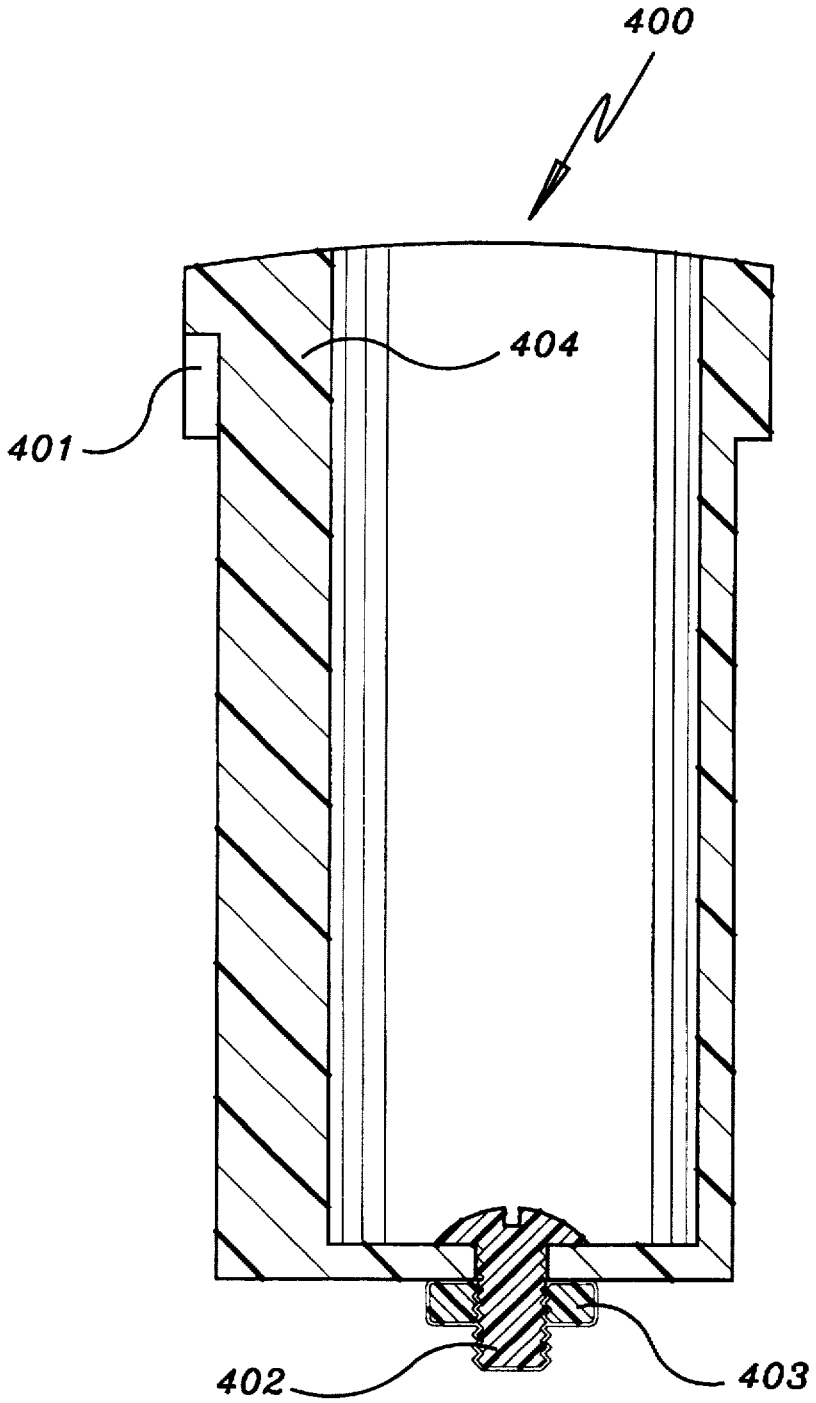
FIG. 4A is a sectional view of a second embodiment of the insert.

A second embodiment of the insert is shown in FIGS. 4A and 4B. Insert 400 includes a round head hex screw 402 and round nut 403 similar in construction and operation to the screw and nut in insert 301 in FIG. 3. Insert 400 has an internal hole with a center axis that is offset and parallel to the center axis of the outer surface of the insert 400. This allows a bowler to adjust the span of the finger and thumb holes by rotating the insert relative to the master. For this purpose, insert 400 includes a mark or orientation point in the form of a longitudinal groove 401 molded into the outer edge of the insert. The groove 401 is visible prior to installing the insert, but as the groove 401 only extends from the bottom of head 404 to approximately half way up the head 404, it is hidden once the insert is installed.

Figure 5:
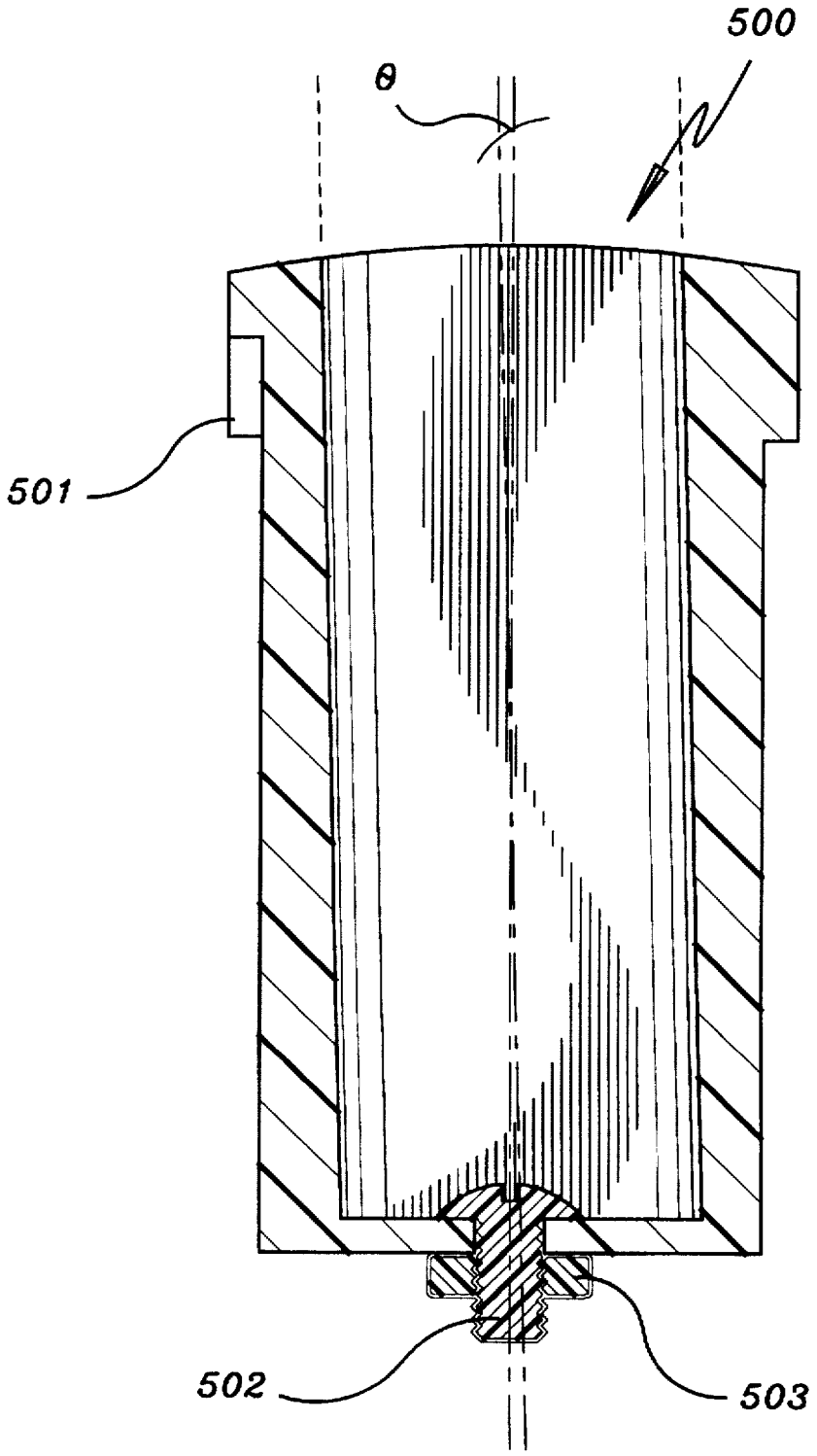
FIG. 5 is a sectional view of a third embodiment of the insert.

A third embodiment of the insert is shown in FIG. 5. Insert 500 includes a round head hex screw 502 and round nut 503 similar in construction and operation to the screw and nut in insert 301 in FIG. 3. Insert 500 has an internal hole with a center axis that is at an angle θ to the center axis of the outer surface of the insert 500. This allows a bowler to adjust the pitch of the finger and thumb holes by rotating the insert relative to the master. For this purpose, insert 500 also includes a mark or orientation point in the form of a longitudinal groove 501 similar in construction and operation to the groove 401 in insert 400. The groove 501, however, is used to indicate the direction of pitch. Additionally, the hole drilled in the bowling ball to accept the master, may be provided with an initial pitch. Insert 500, may then be used to adjust the pitch relative to the initial pitch, or inserts 301 or 400 may be used at the initial pitch.

Figure 6:
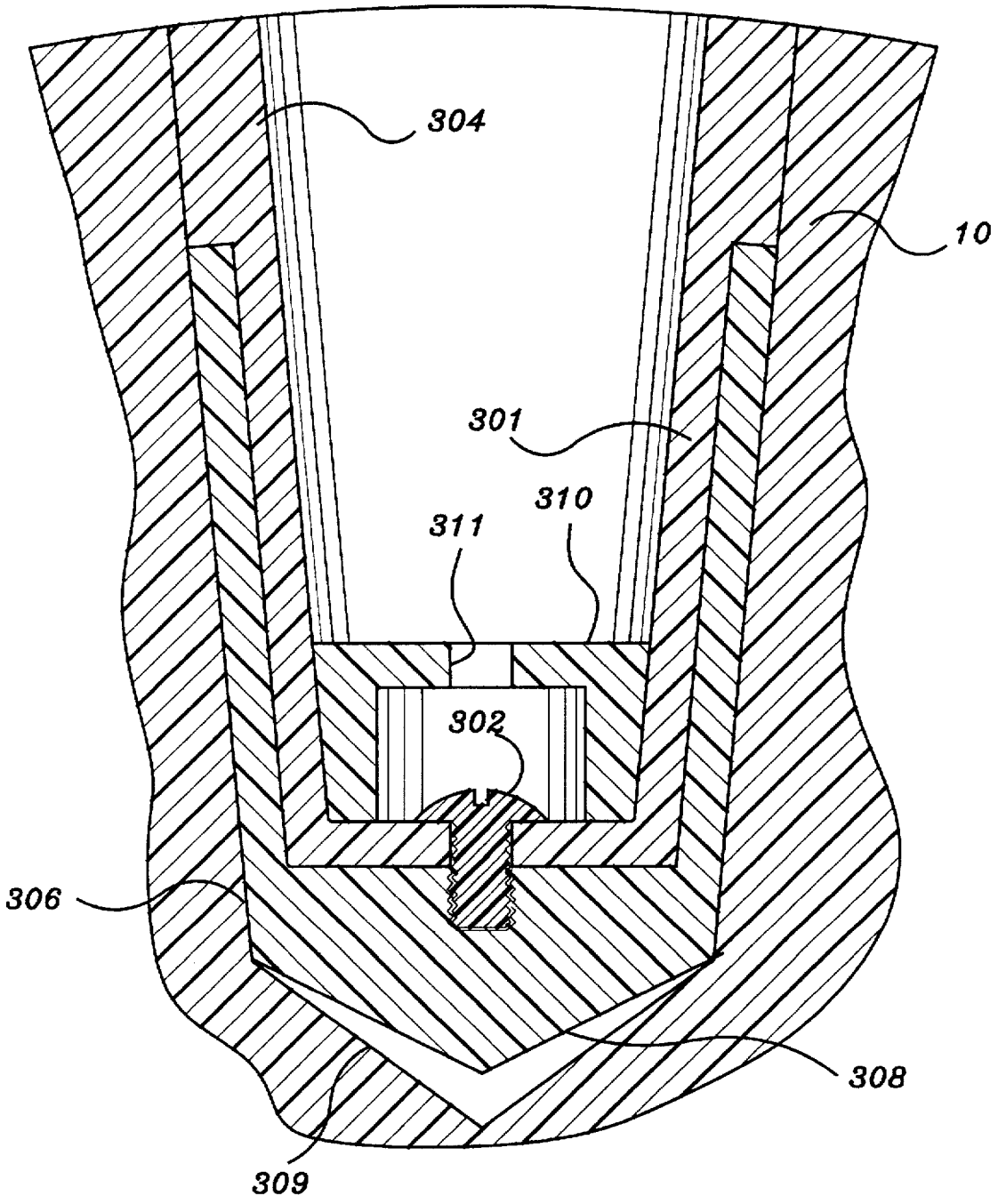
FIG. 6 is a partial-environmental, sectional view of a fourth embodiment of the insert

FIG. 6 shows the fourth, and preferred, embodiment of the insert. The fourth embodiment is similar to the first embodiment shown in FIG. 3, except that the fourth embodiment includes a plug 310 to keep the hex screw 302 within the insert 301 rather than the round nut 303, which is eliminated in this embodiment. The plug 310 is counterbored and has a hole 311 through the center of the plug. The plug 311 is bonded to the internal wall of the insert 301 after the round head hex screw 302 is pushed through the clearance hole from inside the insert 301. The counterbore of the plug 311 acts as a housing for the screw 302, so that the screw 302 will not be able to become separated from the insert 301. The hole 311 through the plug 310 should be large enough to allow the bowler to insert a wrench to tighten the screw 302 into the hole in the master 306. The plug 310 with a hole 311 therethrough makes it easier for the bowler to line the wrench up with the screw 302. The plug 310 should not interfere with the bowler's ability to place his or her fingers within the insert 301.

Figure 7:
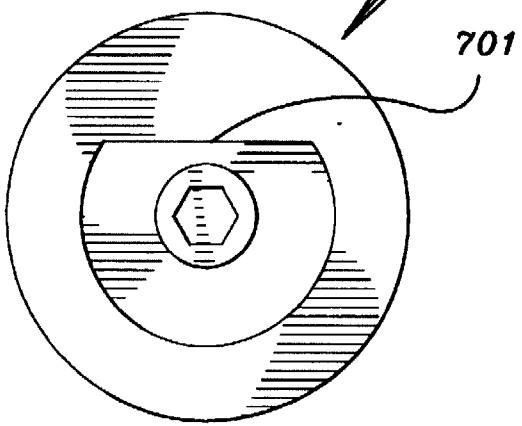
FIG. 7 is a top view of a fifth embodiment of the insert.

FIG. 7 shows a fifth embodiment of the insert 700. In this embodiment the insert 700 is essentially identical to the second embodiment shown in FIG. 2, except that the fifth embodiment has a flat surface 701 on the interior surface of the otherwise cylindrically shaped insert 700. The insert 700 may be rotated so that the bowler's thumb and fingers grasp the flat surfaces 701 thereby giving the bowler greater grip of the bowling ball 10.

It is to be understood that the present invention is not limited to the embodiments described above, but encompasses any and all embodiments within the scope of the following claims.

I claim:

1. An insert system in combination with a bowling ball having a hole, comprising:

a master having a tapered substantially cylindrical inner and outer surface, said master fitting within the hole of the bowling ball; and an insert having a tapered substantially cylindrical outer surface, said insert fitting within said inner surface of said master, said insert having a screw at a bottom portion thereof for connecting said insert to said master.

2. The insert system and bowling ball combination according to claim 1, said insert further comprising a nut threadably engagable with said screw for retaining said screw in said insert when said insert is not connected to said master.

3. The insert system and bowling ball combination according to claim 2, wherein:

said nut is a round nut having an annular outer edge; and said master has a cavity for receiving said round nut when said insert is connected to said master.

4. The insert system and bowling ball combination according to claim 1, further comprising a plug attached to an inner surface of said insert, said plug having an annular outer edge, said plug further having a hole therethrough, and said plug defining a cavity adjacent said screw for retaining said screw in said insert when said insert is not connected to said master.

5. The insert system and bowling ball combination according to claim 1, said master further comprising a threaded bore for threadably engaging said screw when said insert is connected to said master.

6. The insert system and bowling ball combination according to claim 1, said master further comprising a pointed bottom portion having a tapered conical surface.

7. The insert system and bowling ball combination according to claim 1, said inner surface of said master and said outer surface of said insert have a one degree taper.

8. The insert system and bowling ball combination according to claim 1, wherein said insert has an internal hole with a center axis coaxial with a center axis of said outer surface of said insert.

9. The insert system and bowling ball combination according to claim 1, wherein said insert has an internal hole with a center axis offset and parallel to a center axis of said outer surface of said insert.

10. The insert system and bowling ball combination according to claim 1, wherein said insert has an internal hole with a center axis at an angle to a center axis of said outer surface of said insert.

11. A method of installing an insert into a hole of a bowling ball, said method comprising:

drilling a hole having a substantially cylindrical inner wall in said bowling ball;

bonding a master to said inner wall, said master having tapered substantially cylindrical inner and outer surfaces; and connecting an insert to said master, said insert having an outer tapered substantially cylindrical surface conforming to the tapered substantially cylindrical inner surface of said master, thereby forming a strong connection between said insert and said master.

12. The method according to claim 11, wherein said drilling of the hole includes drilling a drill point at the bottom of the hole having a 62 degree taper.

13. The method according to claim 12, wherein said master has a bottom conical portion having a 65 degree taper.

14. The method according to claim 13, wherein said master is bonded to the hole using an adhesive which fills voids formed between said master and the inner wall due to said taper of said outer surface of said master and the difference in taper between the drill point and said conical portion.

15. The method according to claim 11, wherein said insert has a screw and nut assembly that strengthens the connection between said insert and said master.

* * * * *